United States Patent [19]

Yount

[11] 3,967,823

[45] July 6, 1976

[54] TARGET AND SEPARABLE TARGET MARKERS FOR A DART

[76] Inventor: Robert E. Yount, 11108 W. 70th Terrace, Shawnee, Kans. 66203

[22] Filed: June 23, 1975

[21] Appl. No.: 589,125

[52] U.S. Cl. ..... 273/95 R; 273/106.5 B

[51] Int. Cl.[2] ..... F41J 3/00

[58] Field of Search ..... 273/95 R, 102 B, 106.5 R, 273/106.5 A, 106.5 B; 46/DIG. 1

[56] References Cited

UNITED STATES PATENTS

| | | | |
|---|---|---|---|
| 2,770,460 | 11/1956 | Deasy | 273/106.5 R |
| 2,940,759 | 6/1960 | West | 273/106.5 B |
| 3,829,094 | 8/1974 | Goldfarb | 273/95 R |
| 3,857,566 | 12/1974 | Lemelson | 273/95 R |

*Primary Examiner*—Richard G. Pinkham
*Assistant Examiner*—Marvin Siskind
*Attorney, Agent, or Firm*—Fishburn, Gold & Litman

[57] ABSTRACT

A dart game providing marking of the hit or impact point of each of a plurality of separate darts on a target wherein each dart has an end portion having a target marker separably mounted thereon. The target and each of the target markers have respective cooperating portions adapted to retain each target marker on the target at the point of impact of the dart while the dart separates therefrom. Each of the target markers is provided with a textile covering having a surface of pile fabric covering both of its faces. In this manner a second marker can be retained on the backside of a first marker while the front side engages the target.

1 Claim, 4 Drawing Figures

TARGET AND SEPARABLE TARGET MARKERS FOR A DART

The present invention relates to dart games and more particularly to a dart game using a dart having a separable target marker.

The principal objects of the present invention are: to provide a dart game and dart therefor having a separable target marker to permit marking a hit or impact point on the target; to provide such a dart game adapted to effect retaining of a target marker on a target while the dart separates therefrom; to provide such a dart game wherein the target and the target marker have cooperating portions to retain the target marker on the target in a manner requiring greater force to separate same than force required to separate the target marker and the end portion of the dart upon impact of the dart upon the target; to provide such a dart having a target marker adapted to retain thereon a second target marker while being retained on the target; to provide such a dart game wherein the target is formed of resilient material and a target marker extends beyond a peripheral edge of an end portion of the dart wherein impact of the dart on the target effects separation of the target marker from the dart with the target marker being retained on the target; and to provide such a dart game and dart therefor having a separable target marker which is economical to manufacture, durable in construction, simple to use, and particularly well adapted for the purposed use.

Other objects and advantages of this invention will become apparent from the following description taken in connection with the accompanying drawings wherein are set forth, by way of illustration and example, certain embodiments of this invention.

The drawings constitute a part of the specification and include exemplary embodiments of the present invention and illustrate various objects and features of the dart game and dart therefor having separable target marker.

Figure 1:
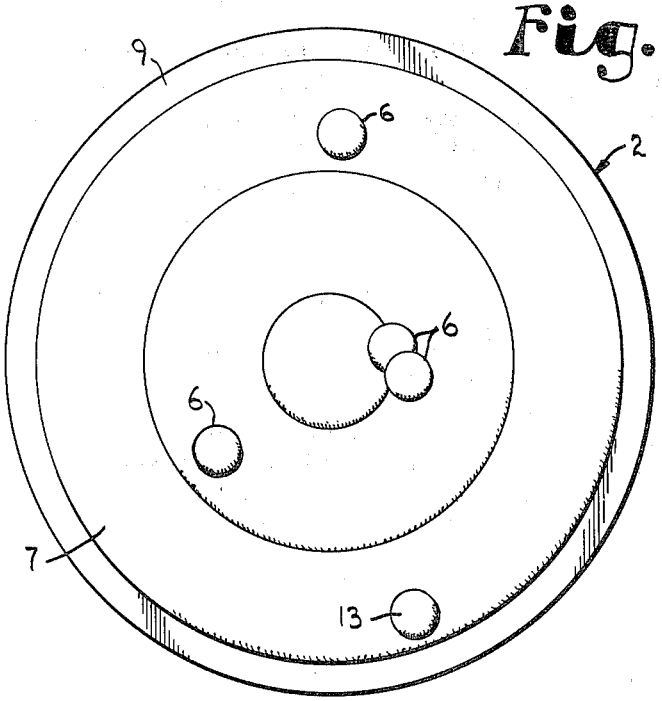
FIG. 1 is a front elevational view of a target for a dart game embodying features of the present invention and showing a plurality of target markers retained thereon.

Referring more in detail to the drawings:

As required, detail embodiments of the present invention are disclosed herein. However, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

In the disclosed embodiment of the present invention, the reference numeral 1 generally designates a dart for use in a dart game and adapted to effect marking of the hit or impact point of each of a plurality of separate darts 1 on a target 2. Each dart 1 has an end portion 3 removably receiving a target marker 6. The target 2 and each of the target markers 6 have cooperating portions 7 and 8 respectively adapted to retain each target markers 6 on the target 2 and point of impact of the dart 1 while the dart separates from the respective target marker 6.

The target 2 preferably has a substantially rigid back or mounting portion 9 adapted to be suitably supported, as by being hung from a wall 10. The portion 7 of the target 2 cooperating with the portion 8 of the target marker 6 is an outwardly presented face adapted to cooperate with material of the target marker face to retain same on impact. In the illustrated structure, the target face is provided with a textile covering having a surface of a pile fabric having upstanding loops, a suitable fabric being "Velcro" fastener material or the like. The pile fabric is resilient whereby the end portion 3 of the dart 1 bounces off the target 2 while the target marker 6 is retained on the target face 7.

The dart has the end portion 3 which cooperates with the marker 6 to mount same and may have separable bonds or the like. In the illustrated structure, the dart has an end portion 3 with a recess or receptacle 5 therein defined by a peripheral wall 4. The target marker 6 is separably mounted in the receptacle 5 in the end portion 3 and is adapted to be retained on the target 2 upon engagement therewith. The target market 6 has a first face 8 which cooperates with the face 7 of the target 2 and is retained thereon. The first face 8 of the target marker 6 is provided with a textile covering having integral outwardly extending stiff hooks and spines formed of broken loops of filament and is thereby adapted for retentive embedment in the face 7 of the target 2 upon contact therewith. A suitable material for the face 8 of the target marker 6 is "Velcro" fastener material or the like.

The filament of the first face 8 of the target marker 6 extends outwardly from a backing portion 11. A second backing portion 12 is suitably secured to the backing portion 11 for the first face 8. The backing portion 12 supports a second or opposite face 13 of the target marker 6. The second face 13 of the target marker 6 is formed of a material which is the same as the face 7 of the target 2 whereby a first face 8 of an other target marker 6 will be retained on the second face 13 upon engagement therewith.

The dart 1 has a body portion 14 formed of an elongated shaft having a plurality of fins 15 at a trailing end thereof to stabilize the dart in flight, as is conventional. The body portion 14 terminates at a shoulder 16 which is engageable with the end portion 3, as later described. A pin 17 extends outwardly from the shoulder 16 and is preferably coaxial with the shaft defining the body portion 14.

The end portion 3 is illustrated as having a shaft 18 with a recess 19 therein adapted to receive and retain the pin 17 therein. The end portion 3 has an end wall 20 which is substantially normal or pendicular to the longitudinal axis of the shaft 18 and the body portion 14 when mounted thereon. The peripheral wall 4 extends outwardly from the end wall 20 to define the recess or receptacle 5 for the target marker 6. The peripheral wall 4 has an end edge 21 and the first face 8 of the target marker 6 extends beyond the end edge 21 whereby the first face 8 of the target marker 6 engages the face 7 of the target 2 before the end edge 21 engages the target 2. The target marker 6 is thereby retained on the target 2 when the end portion 3 of the dart 1 bounces off the target 2. In the structure illustrated, the dart body portion 14 is of suitable molded synthetic resin and the end portion 3 is of metal providing mass or weight providing the inertia to hold the dart on its line of flight.

Use of a dart game and a dart 1 therefor having a separable target marker 6 constructed as illustrated and described is particularly simple. The target 2 is suitably supported on the wall 10. A first dart 1 is thrown toward the target 2 and the first face 8 of the target marker 6 is retained on the face 7 on the target 2. The remainder of the first dart 1 bounces off the target 2 thereby exposing the second face 13 of the target marker 6. The cooperating portions 7 and 8 of the target 2 and the target marker 6 require a greater force to separate same than a force to separate the target marker 6 from the end portion 3 upon impact with the target 2. The weight of the dart 1 is sufficient to effect the separation of the marker 6 when retained on the target 2. When a second dart 1 is thrown toward the target 2, the second face 13 of the target marker 6 retained on the target 2 may be engaged by and retain a first face 8 of the target marker 6 of the second dart 1.

Figure 2:
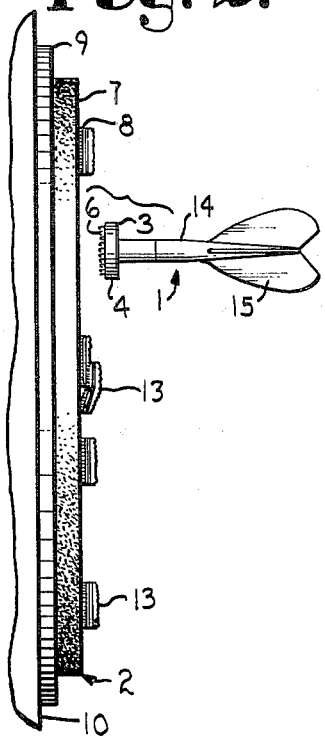
FIG. 2 is a side elevational view of the target and a dart in flight toward same.
Figure 3:
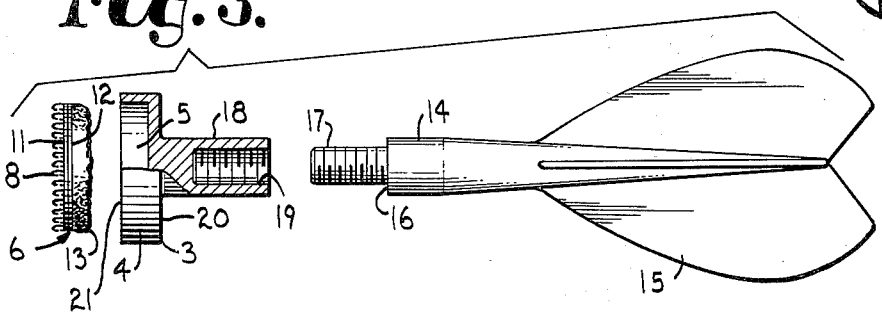
FIG. 3 is an enlarged exploded side elevational view of the dart with portions broken away to show component parts thereof.
Figure 4:
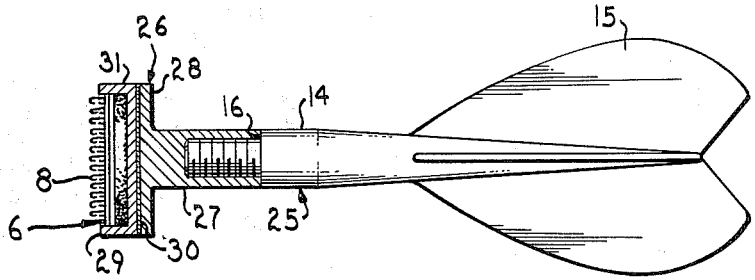
FIG. 4 is an enlarged longitudinal sectional view of a modified dart.

FIG. 4 illustrates a modified dart 25 having a body portion 14 and fins 15 similar to the body portion of the dart 1 illustrated in FIGS. 2 and 3. The modified dart 25 includes an end portion 26 having a shaft 27 similar to the shaft 18 of the end portion 3 and adapted to receive and retain the pin 17 of the body portion 14 therein. The end portion 26 includes a disc 28 which is perpendicular or normal to the longitudinal axis of the shaft 27 and of the body portion 14 when mounted thereon.

A marker receptacle 29 is suitable secured to the disc 28. In the illustrated structure, the marker receptacle 29 has a base wall 28 suitably secured to the disc 30, as by adhesive. The marker receptacle 29 has a peripheral wall 31 extending from the base wall 30 and substantially perpendicular thereto thereby defining a receptacle for the target marker 6 which is similar to the target marker illustrated in FIGS. 1 to 3 inclusive.

The modified dart 25 is used in substantially the same manner as the dart 1 illustrated in FIGS. 2 and 3. The end portions 3 and 26 are preferably formed of a suitable durable material, such as metal, and the marker receptacle 29 may be formed of a suitable plastic by vacuum forming or the like whereby the marker receptacle 29 is substantially economical to manufacture.

It is to be understood that while I have illustrated and described certain forms of my invention, it is not to be limited to these specific forms or arrangement of parts herein described and shown.

What I claim and desire to secure by Letters Patent is:

1. A dart game comprising in combination:

a. a target having an outwardly presented face provided with a textile covering having a surface of a pile fabric having upstanding loops;

b. a plurality of darts each adapted to be thrown toward said target, said darts each having an elongated shaft;

c. an enlarged end portion for each of said darts, said enlarged end portions each having a peripheral wall defining a recess therein, said enlarged end portions each being removably mounted on said shaft of a respective one of said darts;

d. a target marker for each of said enlarged end portions, said target markers each being separably received in a respective one of said enlarged end portions and each having a forwardly presented first face provided with a textile covering having integral outwardly extending stiff hooks and spines formed of broken loops of filament adapted for retentive imbedment in said target surface upon engagement therewith whereby each of said target markers is retained on said target in a manner requiring greater force to separate same than force required to separate said target marker and said enlarged end portion upon impact of said dart upon said target; and e. a second face for each of said target markers and provided with a textile covering having a surface of pile fabric having upstanding loops whereby said second face is adapted to retain thereon said first face of an other of said target markers upon engagement thereby.

* * * * *